US011976896B2

(12) United States Patent
Petersen

(10) Patent No.: US 11,976,896 B2
(45) Date of Patent: May 7, 2024

(54) FIREARM MUZZLE BRAKE WITH GAS-ACTUATED VALVE

(71) Applicant: TRUE VELOCITY IP HOLDINGS, LLC, Garland, TX (US)

(72) Inventor: Byron S. Petersen, Springfield, OR (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

(21) Appl. No.: 17/652,662

(22) Filed: Feb. 25, 2022

(65) Prior Publication Data

US 2023/0272992 A1 Aug. 31, 2023

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/32; F41A 21/325; F41A 21/30; F41A 21/38
USPC ..... 89/14.1–14.5
See application file for complete search history.

(56) References Cited

U.S. PATENT DOCUMENTS 658,934 A * 10/1900 Washington ..... F41A 21/30 89/14.4
832,695 A * 10/1906 Nygaard ..... F41A 21/30 89/14.4
984,750 A * 2/1911 Craven ..... F41A 21/30 89/14.4
1,763,286 A * 6/1930 Wilman ..... F41A 21/30 89/14.3
1,763,287 A * 6/1930 Wilman ..... F41A 21/30 89/14.4
1,773,443 A * 8/1930 Wilman ..... F41A 21/30 89/14.4
3,051,057 A * 8/1962 Ivy ..... F41A 19/52 89/193
4,939,977 A * 7/1990 Stroup ..... F41A 21/30 89/14.4
5,652,406 A * 7/1997 Phan ..... F41A 21/36 89/14.3
10,088,260 B1 * 10/2018 Badanin ..... F41A 21/30
10,718,587 B2 * 7/2020 Barcherini ..... F41A 21/28
10,976,126 B2 * 4/2021 Lo ..... F41A 21/30
2019/0249943 A1 * 8/2019 Barcherini ..... F41A 21/30
2019/0293377 A1 * 9/2019 Barcherini ..... F41A 21/30

OTHER PUBLICATIONS

Petersen, B., "Firearm Suppressor With Gas-Actuated Valve," U.S. Appl. No. 17/652,661, filed Feb. 25, 2022, 36 pages.

* cited by examiner

*Primary Examiner* — Jonathan C Weber
(74) *Attorney, Agent, or Firm* — Burdick Patents, P.A.; Sean D. Burdick; Colin L. Honan

(57) ABSTRACT

Methods and systems are provided for firearm muzzle brakes. In one example, a muzzle brake comprises: a body; a projectile entrance and a projectile exit; a gas-actuated valve biased toward the projectile entrance within an interior of the body; and a projectile opening of the gas-actuated valve arranged along a projectile path between the projectile entrance and the projectile exit.

14 Claims, 8 Drawing Sheets

FIREARM MUZZLE BRAKE WITH GAS-ACTUATED VALVE

FIELD

Embodiments of the subject matter disclosed herein relate to firearm muzzle brakes.

BACKGROUND

Firearms utilize high pressure exhaust gases to accelerate a projectile such as a bullet. Firearm muzzle brakes are often added to the muzzle (exhaust) of a firearm to divert the high pressure exhaust gases of a given firearm. These high pressure exhaust gases are the product of burning nitrocellulose or other propellants and possess significant energy that is used to accelerate the projectile. An exemplary exhaust gas pressure of a rifle cartridge in a full length barrel may be in the range of 7-10 Ksi. A short barreled rifle may have exhaust gas pressures in the 10-20 Ksi range. Moving at supersonic speeds through the bore, the exhaust gases provide the energy to launch the projectile and also result in the emanation of high-decibel noises typically associated with the discharge of firearms. When in action, firearm muzzle brakes lower the kinetic energy and pressure of the propellant gases and thereby reduce a recoil of the firearm.

Firearms muzzle brakes are mechanical gas diverting devices that contain a center through-hole to allow passage of the projectile. Muzzle brake design(s) utilize static geometry to induce gas flow in directions off-axis to the path of the projectile.

Muzzle brakes can be thought of as "in-line" pressure diverting devices that route high pressure gases away from the path of the projectile to reduce firearm recoil. Typical muzzle brake design approaches used to optimize firearms recoil and/or vibration include maximizing internal volume and providing a pathway for propellant gas egress. Each of these approaches must be balanced against the need for clear egress of the projectile, market demand for small overall muzzle brake size, adverse impacts on the firearms performance, and constraints related to the firearms original mechanical design.

However, the inventor herein has recognized potential issues with such systems. As one example, conventional muzzle brake designs may add significant length and weight to a firearm. Although reducing a diameter of a projectile exit of a muzzle brake may increase the redirection of the propellant gases off-axis to the projectile path, the diameter of the projectile exit may not be reduced below a diameter of projectiles sized for the firearm coupled to the muzzle brake. A redirection of the gases away from projectile exit may be realized by increasing a size (e.g., length) of a muzzle brake and/or a number of baffles of the muzzle brake, but the increased size and/or number of baffles may result in an increased muzzle brake weight and/or cost and may reduce a visibility of a target sighted by a user of the firearm.

In one embodiment, the issues described above may be addressed by a muzzle brake comprising a body, a projectile entrance and a projectile exit, a gas-actuated valve biased toward the projectile entrance within an interior of the body, and a projectile opening of the gas-actuated valve arranged along a projectile path between the projectile entrance and the projectile exit. In this way, a projectile fired through the muzzle brake may travel through the projectile opening of the gas-actuated valve and toward the projectile exit. Combustion gases flowing behind the projectile may actuate the gas-actuated valve to close the projectile opening after the projectile has traveled through the projectile opening. By closing the projectile opening via the gas-actuated valve, the combustion gases within the muzzle brake may flow out of the muzzle brake in directions off-axis to the projectile path, and an amount of recoil reduction provided by the muzzle brake may be increased without increasing a size of the muzzle brake.

It should be understood that the summary above is provided to introduce in simplified form, a selection of concepts that are further described in the detailed description. It is not meant to identify key or essential features of the subject matter. Furthermore, the disclosed subject matter is not limited to implementations that solve any disadvantages noted above or in any part of this disclosure.

DETAILED DESCRIPTION

The above drawings are approximately to scale, although other relative dimensions may be used, if desired. The drawings may depict components directly touching one another and in direct contact with one another and/or adjacent to one another, although such positional relationships may be modified, if desired. Further, the drawings may show components spaced away from one another without intervening components therebetween, although such relationships again, could be modified, if desired.

An example firearm muzzle brake including a gas-actuated valve is described herein. The following description relates to various embodiments of the firearm muzzle brake as well as methods of manufacturing and using the device. Potential advantages of one or more of the example approaches described herein relate to increasing operating performance, reducing recoil and/or vibration of the firearm, and various others as explained herein.

Figure 1:
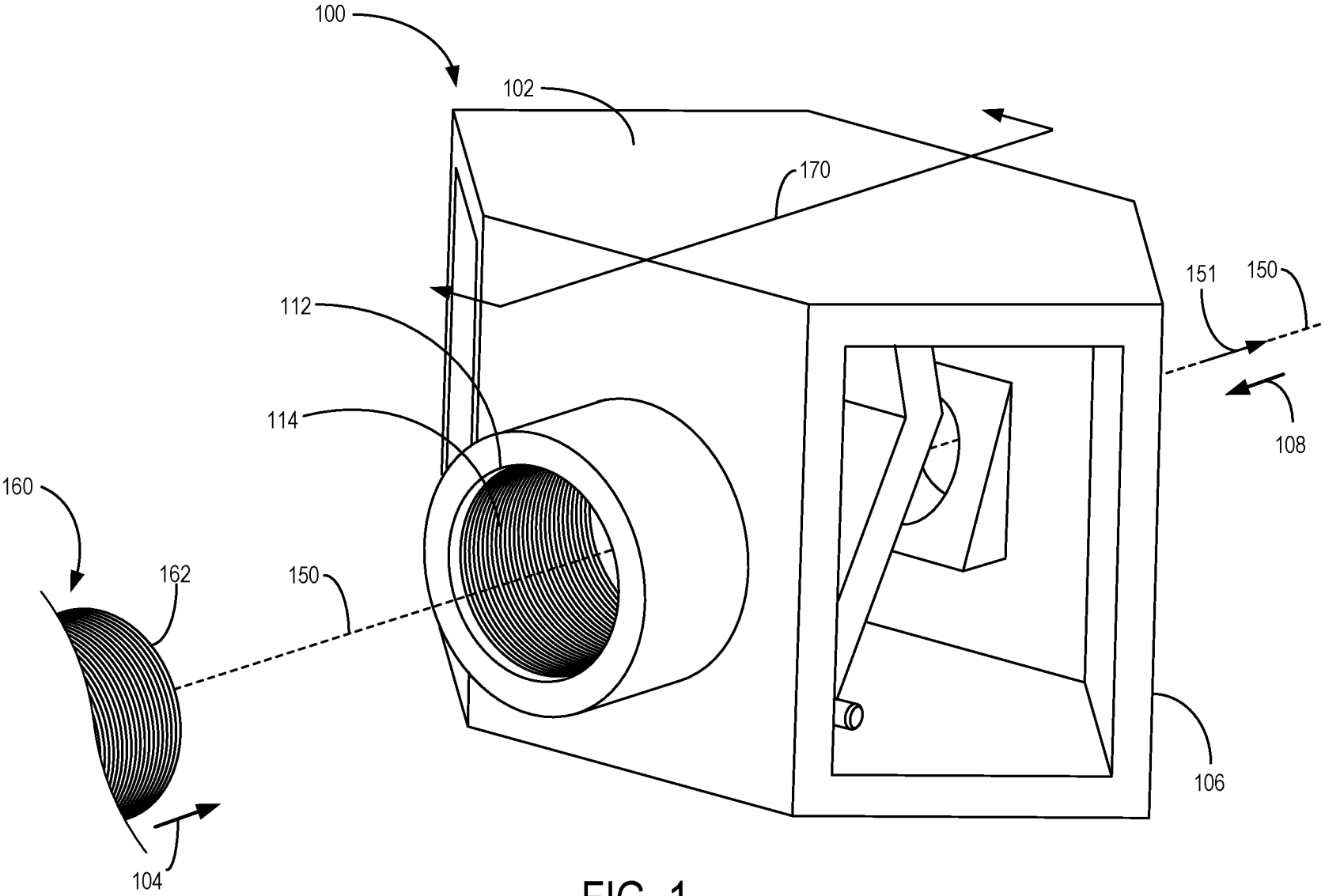
FIG. 1 shows a first perspective view of a muzzle brake including a gas-actuated valve according to an embodiment of the present disclosure.
Figure 3:
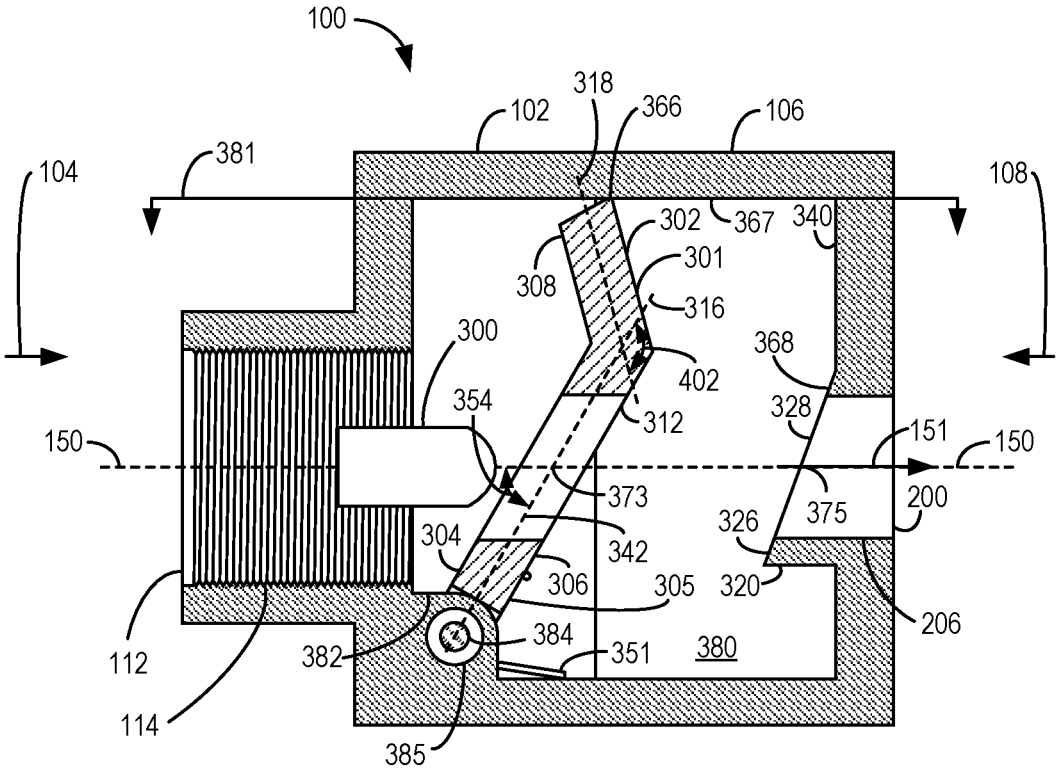
FIG. 3 shows a first sectional side view of the muzzle brake with the gas-actuated valve in a first position.
Figure 4:
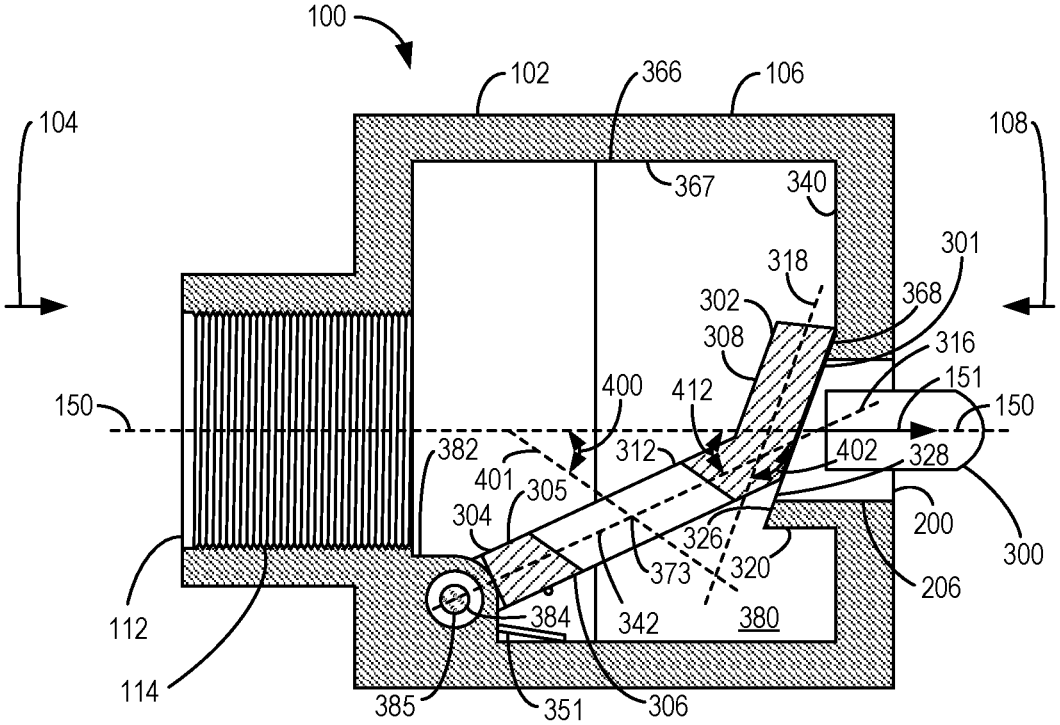
FIG. 4 shows a second sectional side view of the muzzle brake with the gas-actuated valve in a second position.
Figure 5:
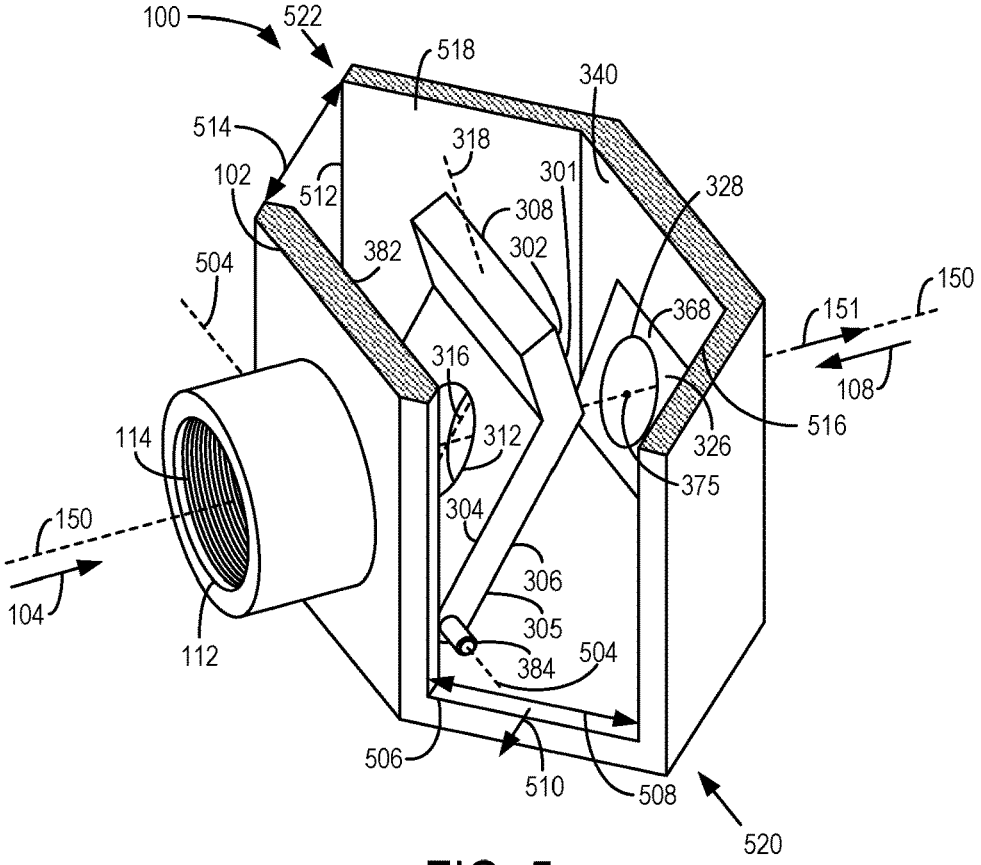
FIG. 5 shows a sectional perspective view of the muzzle brake with the gas-actuated valve in the first position.
Figure 6:
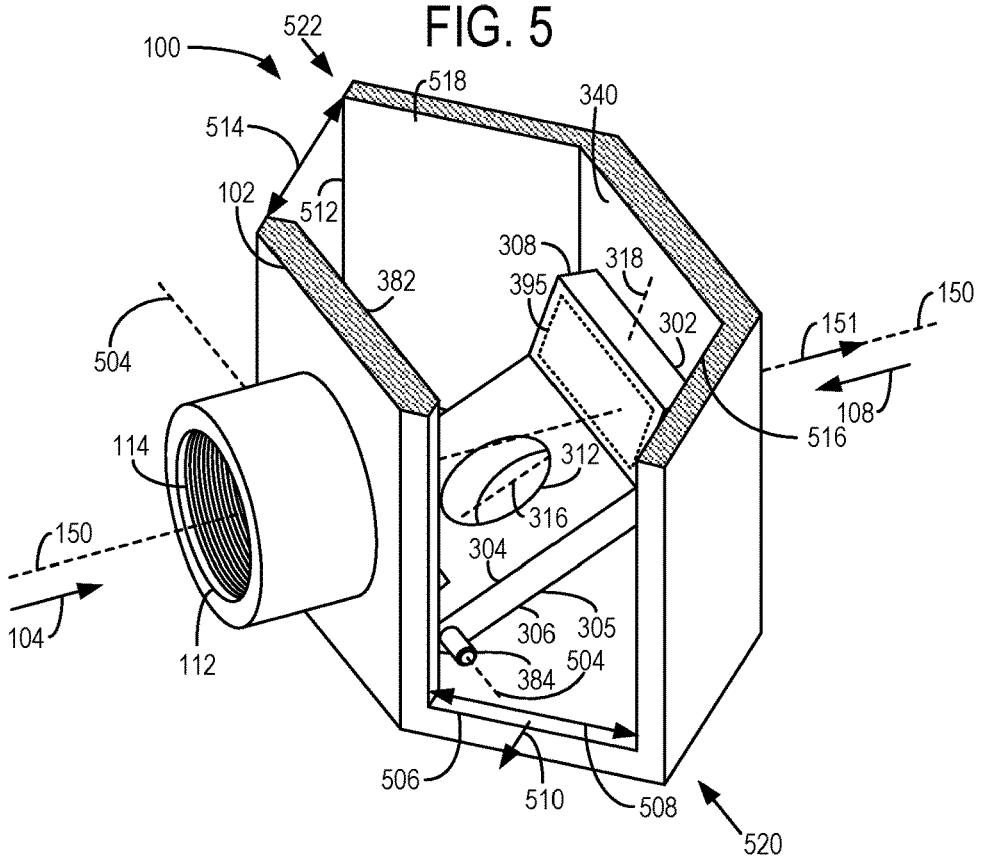
FIG. 6 shows another sectional perspective view of the muzzle brake with the gas-actuated valve in the second position.

The firearm muzzle brake including the gas-actuated valve may be coupled to a firearm, as described with regard to FIG. 1. The muzzle brake may include a shoulder, as shown by FIGS. 3-5, where the shoulder is arranged opposite to the gas-actuated valve within an interior of a body of the muzzle brake. In some embodiments the gas-actuated valve may be integrated with an insert shaped to seat within the interior of the body of the muzzle brake. A projectile fired by the firearm through the muzzle brake travels from a projectile entrance of the muzzle brake to a projectile exit of the muzzle brake. Gases generated by the firing of the projectile may flow against the gas-actuated valve after the projectile has traveled completely through an opening of the gas-actuated valve. The gases move the gas-actuated valve from an un-actuated position (as shown by FIGS. 3, 5, and 9-10) to an actuated position (as shown by FIGS. 4, 6 and 11) to close an opening of the shoulder through which the projectile passes. As a result, an amount of gases flowing out of the muzzle brake via the projectile exit may be reduced, with the gases being redirected off-axis relative to the path of the projectile through the muzzle brake and through side openings of the muzzle brake. The reduced flow of the gases through the projectile exit may result in an increased recoil reduction efficiency of the muzzle brake.

Configuring the muzzle brake to include the gas-actuated valve may provide the muzzle brake with significant recoil reduction gains. The gas-actuated valve is arranged immediately adjacent to the muzzle (e.g., exhaust end) of the firearm barrel during conditions in which the muzzle brake is coupled to the firearm. The gas-actuated valve may occupy a space at a periphery of an area in which the gases exhibit incompressible flow boundary layers, which may be referred to as a shock bottle. By closing the opening of the shoulder after a projectile has passed completely through the opening of the gas-actuated valve, the gas-actuated valve may redirect gases expelled by the firearm through side openings of the muzzle brake and reduce an amount of recoil and/or vibration of the muzzle brake. In particular, the gas-actuated valve is configured to redirect gases away from the opening of the shoulder and along walls of the muzzle brake toward side openings of the muzzle brake. By redirecting the gases away from the projectile path and through the side openings, an efficiency of the muzzle brake may be increased.

FIGS. 1-11 show the relative positioning of various components of the muzzle brake assembly. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

Elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being triangular, helical, straight, planar, curved, rounded, spiral, angled, or the like). Further, elements shown intersecting one another may be referred to as intersecting elements or intersecting one another, in at least one example. Further still, an element shown within another element or shown outside of another element may be referred as such, in one example. For purpose of discussion, FIGS. 1-8 will be described collectively.

Referring to FIG. 1, an exterior perspective view of a muzzle brake 100 according to an embodiment of the current disclosure is shown. The exterior view of the muzzle brake 100 is shown in order to illustrate the overall shape of the muzzle brake and relative spatial positioning. As shown in the figure, the muzzle brake 100 comprises a body 102 (which may be referred to herein as a housing and/or casing), a rearward end 104, an outer surface 106, a forward end 108, and projectile entrance passage 112.

The muzzle brake 100 comprises projectile entrance passage 112 (which may be referred to herein as a projectile entrance) forming a generally annular channel at the rearward end 104 wherethrough a projectile such as a bullet may enter to pass through and exit the muzzle brake 100 at the forward end 108. The projectile may travel along a projectile path 151 coaxial with a central axis 150 of the muzzle brake 100.

The longitudinally rearward end 104 contains the projectile entrance passage 112, an opening sufficiently large enough to permit passage of at least a portion of a firearm barrel (e.g., firearm barrel 160), where the muzzle brake 100 may attach via connectable interaction devices such as interlacing threads. For example, muzzle brake 100 may include threads 114 configured to engage (e.g., interlock) with counterpart threads 162 of firearm barrel 160. Threads are depicted for attaching the muzzle brake to the firearm in this embodiment, however, other methods of attachment may be used. For example, lugs, external threads on flash hiders, pawls, collets, cross-bolts, clamps, notches, or combinations thereof may be used.

Figure 2:
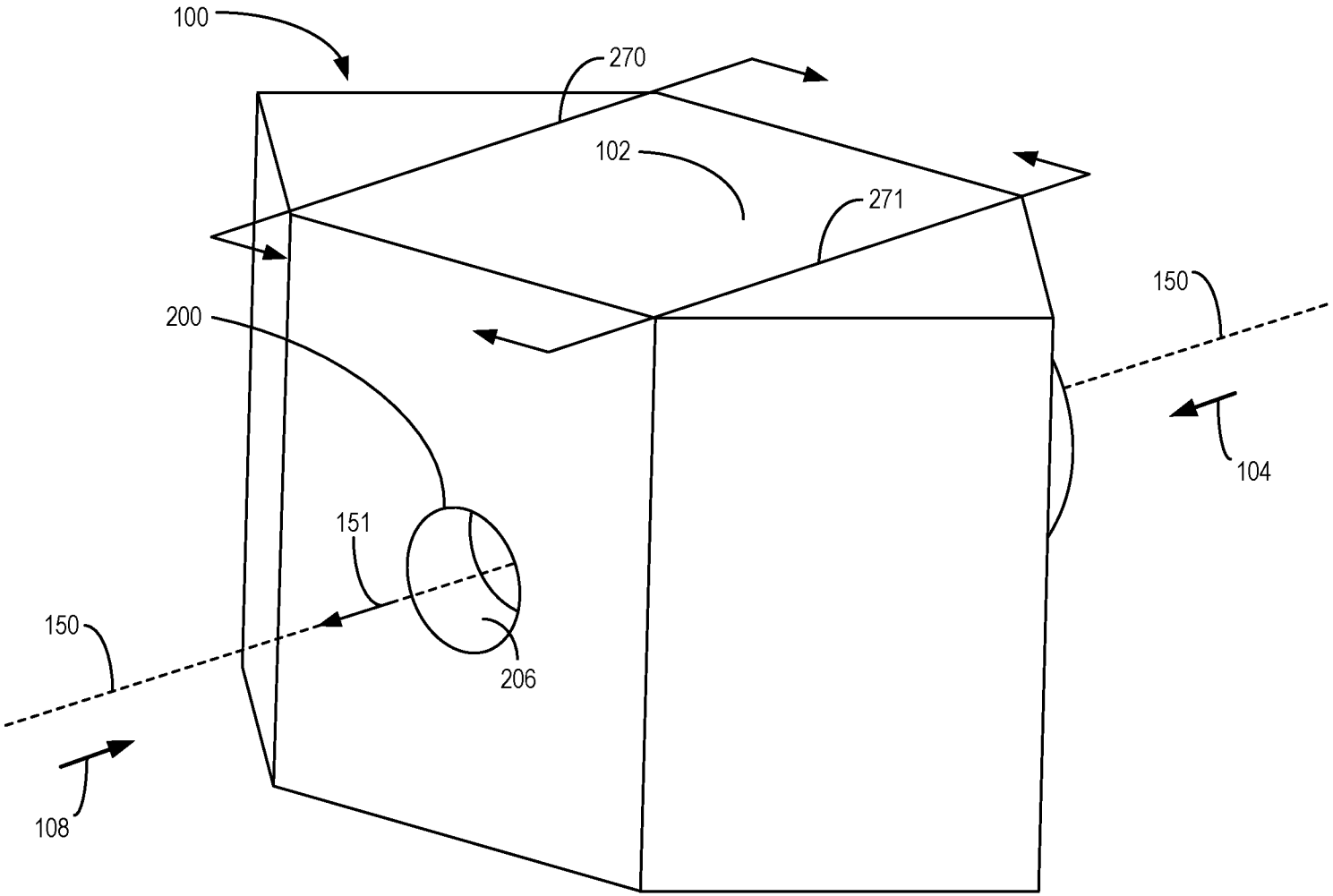
FIG. 2 shows a second perspective view of the muzzle brake.

Referring to FIG. 2, a second perspective view of the muzzle brake 100 is shown. FIG. 2 shows the forward end 108 of the muzzle brake 100, where the forward end 108 includes a projectile exit passage 200 (which may be referred to herein as a projectile exit). During a firing event of a firearm coupled to the muzzle brake 100, for example, a projectile fired by the firearm may travel through the muzzle brake 100 in a direction from the projectile entrance passage 112 at the rearward end 104 toward the projectile exit passage 200 at the forward end 108 (e.g., in a direction of central axis 150 through the muzzle brake 100).

Referring to FIGS. 3 and 5, the muzzle brake 100 is shown with a gas-actuated valve 302 in a non-actuated position, as described further below. In particular, FIG. 3 shows a first sectional side view of the muzzle brake 100 taken along line 170 shown by FIG. 1, and FIG. 5 shows a first sectional perspective view of the muzzle brake 100 taken along line 270 shown by FIG. 3. The muzzle brake 100 includes the gas-actuated valve 302 and a shoulder 320 arranged opposite to each other within an interior 380 of the body 102. The gas-actuated valve 302 is shown by FIGS. 3 and 5 in the non-actuated position (which may be referred to herein as an equilibrium position, neutral position, and/or open position) wherein the gas-actuated valve 302 is not rotated (e.g., pivoted) by combustion gases (e.g., propellant gases) generated by a firing of projectile 300 (shown by FIG. 3) by the firearm 160 (shown by FIG. 1). As one example, the gas-actuated valve 302 may be in the non-actuated position during conditions in which combustion gases are not within the muzzle brake 100. The gas-actuated valve 302 may additionally be in the non-actuated position during conditions in which a projectile (e.g., projectile 300) has been fired by the firearm 160 into the muzzle brake 100 and the projectile has not passed through the gas-actuated valve 302. For example, projectiles fired by the firearm 160 into the muzzle brake 100 travel along central axis 150 of the muzzle brake 100 in a direction from projectile entrance 112 to projectile exit 200. While a projectile fired by the firearm 160 is traveling within the muzzle brake 100 between the projectile entrance 112 and the gas-actuated valve 302, the gas-actuated valve 302 is configured to be maintained in the non-actuated position shown by FIGS. 3 and 5. However, after the projectile has traveled completely through opening 312 (which may be referred to herein as a projectile opening, valve projectile opening, etc.) of the gas-actuated valve 302 and is within the muzzle brake 100 between the gas-actuated valve 302 and the projectile exit 200, the gas-actuated valve 302 may transition from the non-actuated position to an actuated position (shown by FIGS. 4 and 6), as described further below.

The gas-actuated valve 302 is arranged toward the rearward end 104 and the shoulder 320 is arranged toward the forward end 108. In particular, the gas-actuated valve 302 extends within the interior 380 from a pivot 384 arranged toward the projectile entrance 112 at the rearward end 104, and the shoulder 320 extends within the interior 380 from the projectile exit 200 at the forward end 108. The shoulder 320 is fixed (e.g., fixedly joined) to end wall 340 forming the projectile exit 200. The projectile entrance 112 is formed in wall 382, and the gas-actuated valve 302 is pivotable relative to the wall 382 via pivot 384. The pivot 384 is seated within an opening 385 formed by the wall 382 and is directly joined to the gas-actuated valve 302 such that the gas-actuated valve 302 is rotated along axis 504 (shown by FIGS. 5-8) during conditions in which the pivot 384 rotates within the opening 385 of the wall 382. In the example shown, the pivot 384 and the wall 382 are separate structures (e.g., the pivot 384 and gas-actuated valve 302 may be inserted into the body 102 of the muzzle brake 100 and may be separate from the body 102). However, in some examples, the pivot 384, gas-actuated valve 302, and body 102 may be formed together as a single, continuous structure (e.g., the pivot 384 and the wall 382 may be formed together as a single piece such that the pivot 384 is maintained fixed to the wall 382 without fasteners, welding, etc., with the gas-actuated valve 302 cantilevered into the interior 380 and pivotable from pivot 384). For example, the pivot 384 may be a portion of the gas-actuated valve 302 having a stiffness configured to enable the gas-actuated valve 302 to pivot (e.g., rotate) relative to the wall 382 during conditions in which force is applied to surfaces of the gas-actuated valve 302 by combustion gases generated during the firing of a projectile through the muzzle brake 100. Additionally, the stiffness of the pivot 384 may be configured to urge the gas-actuated valve 302 toward the non-pivoted position during conditions in which the gas-actuated valve 302 is pivoted relative to the wall 382. In the example shown, however, the pivot 384 is a separate component relative to the wall 382. In the configuration shown, the gas-actuated valve 302 is coupled to a biasing member (e.g., spring 351), and the biasing member biases the gas-actuated valve 302 toward the non-actuated position. In the example shown, the biasing member is spring 351. The spring 351 may be a coil spring, torsion spring, etc. The shape and/or material of the spring 351 may be selected to provide a particular desired stiffness (e.g., spring constant) of the spring 351. In examples in which the pivot 384, gas-actuated valve 302, and wall 382 are formed together as a single piece, a shape and/or material of the pivot, wall, and/or gas-actuated valve may be selected to provide a particular desired spring constant of the gas-actuated valve 302.

The gas-actuated valve 302 includes a base section 305 coupled to the pivot 384, and an angled extension section 308 joined to the base section 305. The projectile opening 312 is formed in the base section 305. The base section 305 may be arranged in-line (e.g., aligned) with the central axis 150, with the angled extension section 308 extending from the base section 305 away from the central axis 150 during conditions in which the gas-actuated valve 302 is in the unactuated position. In this configuration, the projectile opening 312 is arranged along the central axis 150 during conditions in which the gas-actuated valve 302 is in the non-actuated (e.g., equilibrium) position.

The gas-actuated valve 302 may be moved between the non-actuated position (shown by FIGS. 3 and 5) and the actuated position (shown by FIGS. 4 and 6) responsive to a flow of combustions gases within the muzzle brake 100. The non-actuated position may be referred to herein as the equilibrium position, non-pivoted position, neutral position, and/or open position (e.g., the position of the gas-actuated valve 302 during conditions in which force is not applied to the gas-actuated valve 302 by combustion gases generated via firing of a projectile through the muzzle brake 100). The gas-actuated valve 302 is configured to transition from the non-actuated position to the actuated position responsive to a flow of the combustions gases against surfaces of the gas-actuated valve 302 (e.g., during conditions in which the muzzle brake 100 is coupled to the firearm 160 and the firearm 160 fires a projectile through the muzzle brake 100). The gas-actuated valve 302 includes opening 312 (which may be referred to herein as a valve projectile opening) shaped such that a projectile fired by the firearm 160 through the muzzle brake 100 passes through the opening 312 along projectile path 151 between the projectile entrance 112 and the projectile exit 200. While the gas-actuated valve 302 is in the non-actuated position (which may be referred to herein as an equilibrium position), the opening 312 of the gas-actuated valve 302 is arranged along the projectile path 151 coaxially with an opening 328 of the shoulder 320. The opening 328 is formed in an angled end surface 326 of the shoulder 320 and is shaped such that the projectile may pass through the opening 328 toward the projectile exit 200. The opening 328 may be referred to herein as a shoulder opening, projectile opening, shoulder projectile opening, etc. After the projectile (e.g., projectile 300) has passed entirely through the opening 312 of the gas-actuated valve 302 (e.g., traveled completely through the opening 312 such that no portion of the projectile is within the opening 312), combustion gases trailing the projectile (e.g., flowing behind the projectile) and resulting from the firing of the projectile from the firearm 160 flow against surfaces of the gas-actuated valve 302 (e.g., wall 301) and urge the gas-actuated valve 302 toward the actuated position. In the actuated position, the opening 312 of the gas-actuated valve 302 is arranged off-axis (e.g., off-center) to the central axis 150 and the projectile path 151 (e.g., as shown by FIG. 4), and the opening 328 of the shoulder 320 is closed by the gas-actuated valve 302 (e.g., wall 301 is positioned adjacent to the opening 328 such that gases do not flow directly through the opening 312 of the gas-actuated valve 302 to the opening 328 of the shoulder 320 in the direction of central axis 150).

While the gas-actuated valve 302 is in the non-actuated position, the base section 305 may be angled relative to the central axis 150 by angle 354 (where angle 354 is shown between axis 342 and central axis 150, with axis 342 extending parallel with the base section 305 along a center of the base section 305). The base section 305 includes an upper surface 304 and a lower surface 306, where the lower surface 306 is arranged closer to the central axis 150 and the upper surface 304 is arranged further from the central axis 150. Angled extension section 308 is angled relative to the base section 305 (as indicated by angle 402 between axis 318 and axis 316 as shown by FIGS. 3-4, where the axis 318 is parallel with the angled extension section 308 and centered to the angled extension section 308 and the axis 316 is parallel with the base section 305 and centered to the base section 305). During conditions in which the gas-actuated valve 302 is pivoted to the actuated position, the angled extension section 308 may be arranged in face-sharing contact with to the shoulder 320 (e.g., directly contacting the shoulder 320, with no other components arranged between the angled extension section 308 and the shoulder 320) and may reduce a likelihood of combustion gases flowing into the opening 328 of the shoulder 320 until the gas-actuated valve 302 returns to the non-actuated position (e.g., equilibrium position).

During conditions in which the gas-actuated valve 302 is in the non-actuated position (as shown by FIGS. 3 and 5), a midpoint 373 of the projectile opening 312 of the gas-actuated valve 302 is arranged along the projectile path 151, with the base section 305 angled to the central axis 150 by angle 354 (shown by FIG. 3). During conditions in which the gas-actuated valve 302 is in the actuated position (as shown by FIGS. 4 and 6), midpoint 373 of the projectile opening 312 of the gas-actuated valve 302 is offset from the projectile path 151, and the base section 305 is angled to the central axis 150 by angle 412. The angle 354 may be greater than the angle 412 such that during conditions in which the gas-actuated valve 302 is in the actuated position, the base section 305 is arranged closer to a position parallel with the central axis 150 (e.g., more horizontal) relative to conditions in which the gas-actuated valve 302 is in the unactuated position.

In some embodiments, the gas-actuated valve 302 may include a plurality of longitudinal notches extending between the pivot 384 and the angled extension section 308. The longitudinal notches may be referred to herein as slots and may extend through an entire thickness of the base section 305. The longitudinal notches may enable the gas-actuated valve 302 to pivot responsive to combustion gas flow within the muzzle brake 100 during conditions in which a degradation of the gas-actuated valve 302 has occurred. For example, during conditions in which degradation of a portion of the base section 305 has occurred, the longitudinal notches may isolate the degraded portion from the non-degraded portions so that the non-degraded portions may provide the pivoting of the gas-actuated valve 302 without contribution from the degraded portions.

In some embodiments, the gas-actuated valve 302 may include a first valve stop 368 formed by the shoulder 320 and shaped to contact the gas-actuated valve 302 during conditions in which the gas-actuated valve 302 is in an actuated position, and/or a second valve stop 366 (formed by wall 367) shaped to contact the gas-actuated valve 302 during conditions in which the gas-actuated valve 302 is in a non-actuated position. For example, the gas-actuated valve 302 may be rotationally biased by spring 351 around pivot 384 in a direction toward the projectile entrance 112 during conditions in which combustions gases are not within the interior 380 of the muzzle brake 100. In order to maintain the gas-actuated valve 302 in the non-actuated position shown by FIGS. 3 and 5 while the spring 351 urges (e.g., biases) the gas-actuated valve 302 toward the projectile entrance 112, the second valve stop 366 may limit (e.g., restrict) a range of motion (e.g., a range of pivoting) of the gas-actuated valve 302 in the direction toward the projectile entrance 112. In particular, as the gas-actuated valve 302 is urged toward the projectile entrance 112, the angled extension section 308 may come into direct face-sharing contact with the second valve stop 366 and may be prevented from rotating beyond the second valve stop 366. The second valve stop 366 may be a portion of the wall 367, with the wall 367 and the second valve stop 366 fixed (e.g., non-pivotable) relative to the gas-actuated valve 302. As an example, during conditions in which combustion gases move (e.g., pivot) the gas-actuated valve 302 away from the projectile entrance 112, the first valve stop 368 may limit (e.g., restrict) the range of motion of the gas-actuated valve 302 in the direction away from the projectile entrance 112. For example, the gas-actuated valve 302 may pivot to close the opening 328 of the shoulder 320 but may be prevented from pivoting further while the angled extension section 308 is in face-sharing contact with the first valve stop 368 (as shown by FIG. 4). The first valve stop 368 may be an angled portion of the shoulder 320 extending into the interior 380 from wall 340. In such configurations, the gas-actuated valve 302 may seat against the first valve stop 368 without gaps or clearances between the angled extension section 308 and the angled end surface 326 of the shoulder 320 (e.g., the angled extension section 308 may engage directly with the angled end surface 326 and seat against the angled end surface 326 at the first valve stop 368).

Configuring the muzzle brake 100 to include the first valve stop 368 and/or the second valve stop 366 may reduce a likelihood of oscillation of the gas-actuated valve 302 during conditions in which the gas-actuated valve 302 is pivoted responsive to the force of combustion gases against the gas-actuated valve 302. By reducing the likelihood of oscillation of the gas-actuated valve 302, a likelihood of degradation of the gas-actuated valve 302 and/or other components of the muzzle brake 100 may be reduced. As one example, the first valve stop 368 and second valve stop 366 may increase a damping of oscillation of the gas-actuated valve 302 by limiting the range of motion of the gas-actuated valve 302 as described above. In particular, the gas-actuated valve 302 may be urged in the direction toward the second valve stop 366 by the spring 351 during conditions in which the gas-actuated valve 302 is not pivoted by combustion gases. By configuring the gas-actuated valve 302 to be biased toward the second valve stop 366 (which may be referred to herein as preloading the gas-actuated valve 302), the amount of damping of the gas-actuated valve 302 may be increased during conditions in which combustion gases apply force against the gas-actuated valve 302 to pivot the gas-actuated valve 302 toward the shoulder 320.

In some embodiments, the gas-actuated valve 302 may be formed from a metal material such as spring steel, titanium, etc. An amount of biasing of the gas-actuated valve 302 in the direction away from the shoulder 320 may be a function of the spring constant of the spring 351. In some embodiments, the spring constant may be further based on a pre-determined rate of fire of projectiles through the muzzle brake 100. For example, the spring constant may be based on a maximum rate of fire of a firearm (e.g., firearm 160 shown by FIG. 1) to which the muzzle brake 100 couples. As one example, the spring constant may be higher for higher firing rates, and the spring constant may be lower for lower firing rates. In some embodiments, the gas-actuated valve 302 may be formed (e.g., manufactured) from the metal material as a monolithic and unitary structure. For example, the gas-actuated valve 302 may be molded or formed via an additive manufacturing process (e.g., 3D printing) without fasteners or other components. 3D printing may include selective laser melting (SLM), fused deposition modeling (FDM), sterolithography (SLA), laminated object manufacturing (LOM), etc. In some embodiments, the gas-actuated valve 302 may be formed from a first material (e.g., a first metal material) as described above, and other portions of the muzzle brake 100 (e.g., body 102) may be formed from a different, second material (e.g., a second metal material, a composite material, etc.).

In some embodiments, the gas-actuated valve 302 may be a component separate from the body 102 that is shaped to seat within the body 102. In other embodiments, the gas-actuated valve 302 may be formed together with the body 102 and may be pivotable relative to the body 102 via pivot 384 (e.g., the gas-actuated valve 302 and body 102 may be formed together via an additive manufacturing process as described above). In yet other examples, the gas-actuated valve 302 and the pivot 384 may be formed together or coupled together separate from the body 102 and may be seated together within the body 102 as a single unit (e.g., arranged within interior 380 of the body 102 and joined to the body 102 via welding or another process). In some embodiments, the gas-actuated valve 302 may be removable (e.g., replaceable) from the body 102, and in other embodiments the gas-actuated valve 302 may be joined directly to the body 102 (e.g., welded to the body 102, overmolded into the body 102, etc.). By forming the gas-actuated valve 302 separately from the body 102, an ease of maintenance of the muzzle brake 100 may be increased. For example, the gas-actuated valve 302 may be removable from the body 102 for cleaning, inspection, replacement, etc.

The gas-actuated valve 302 may include a blowout panel 395 (indicated in FIG. 6 by broken lines). The blowout panel 395 may be an area of the gas-actuated valve 302 that is configured to burst open responsive a projectile (e.g., bullet) fired through the muzzle brake 100 (e.g., projectile 300) coming into contact with the blowout panel 395. Discharge of the firearm may proceed even after rupturing of the blowout panel 395 albeit with reduced efficiency of recoil suppression. Bursting of the blowout panel 395 responsive to contact of the projectile with the blowout panel 395 enables the projectile to pass through the muzzle brake 100 with a reduced likelihood of degradation of other areas of the gas-actuated valve 302 and/or other portions of the muzzle brake 100. The blowout panel 395 may be a recess in the angled extension section 308 of the gas-actuated valve 302. In the example shown, the blowout panel 395 is a rectangular recess indicated by broken lines. However, in other examples, the blowout panel 395 may be a recess having a different shape (e.g., circular shape, elliptical shape, hexagonal shape, etc.). A thickness of the angled extension section 308 at the location of the blowout panel 395 may be reduced relative to a thickness at other portions of the angled extension section 308. As one example, the thickness of the angled extension section 308 at the blowout panel 395 may be between 10-90% of the thickness of other portions of the angled extension section 308. In some embodiments, the blowout panel 395 may be formed from a different material than other portions of the angled extension section 308. For example, the blowout panel 395 may be formed from a first material having a lower density (e.g., a first metal or metal alloy) and the other portions of the angled extension section 308 may be formed from a second material having a higher density (e.g., a second metal or metal alloy). The density of the first material may be between 10-90% of the density of the second material, in one example. In some examples, the blowout panel 395 may be an aperture adapted with a plug, and during conditions in which the projectile comes into direct contact with the plug, the blowout panel 395 may burst (e.g., the plug may be ejected).

During conditions in which the gas-actuated valve 302 is in the non-actuated position, the opening 312 of the gas-actuated valve 302 is arranged opposite to (e.g., across from) the opening 328 of the shoulder 320. While the opening 328 is not closed by the gas-actuated valve 302, the opening 328 fluidly couples the interior 380 of the body 102 to an exterior of the body 102 (e.g., to atmosphere). The central axis 150 intersects a midpoint 373 of the opening 312 and a midpoint 375 of the opening 328. The opening 328 may be referred to herein as a shoulder projectile entrance and may be the only entrance of a projectile into the shoulder 320. Projectile passage 206 may have a circular profile (e.g., shaped as a cylinder). The projectile passage 206 is sized such that a projectile fired by the firearm coupled to the muzzle brake 100 passes through the projectile passage 206 during travel through the muzzle brake 100 from the rearward end 104 to the forward end 108. The shoulder 320 and the gas-actuated valve 302 may together reduce an overall mass flow rate of the exhaust gases (which may be referred to herein as propellant gases and/or combustion gases) of the firearm through the projectile exit 200 and therefore reduce the overall energy signatures of the firearm. Additionally, a turbulence of gas at the projectile exit 200 may be reduced which may decrease a likelihood of destabilization of the projectile 300 (e.g., decrease a likelihood of deviation of the projectile 300 from the projectile path 151).

In some examples, the shoulder 320 may include a relief (e.g., a depression, slot, recess, etc.) shaped to enable a portion of the propellant gases (e.g., 5% of the propellant gases, 10% of the propellant gases, etc.) to flow through the projectile exit 200 during conditions in which the gas-actuated valve 302 is in the actuated position while a remainder of the propellant gases are blocked from flowing through the projectile exit 200 by the gas-actuated valve 302.

Referring to FIGS. 4 and 6, the muzzle brake 100 is shown with a gas-actuated valve 302 in the actuated position. In particular, FIG. 4 shows a second sectional side view of the muzzle brake 100 taken along line 170 shown by FIG. 1, and FIG. 6 shows a second sectional perspective view of the muzzle brake 100 taken along line 270 shown by FIG. 2, with the gas-actuated valve 302 in the actuated position in each of the views shown by FIGS. 4 and 6. The gas-actuated valve 302 is pivoted in FIGS. 4 and 6 relative to the non-actuated position shown by FIGS. 3 and 5 as a result of combustion gases urging the gas-actuated valve 302 toward the shoulder 320.

In the actuated position shown by FIGS. 4 and 6, because the gas-actuated valve 302 closes the opening 328 of the shoulder 320, gas does not flow through the gas-actuated valve 302 along the central axis 150 into the projectile exit 200. However, combustion gases may flow through the opening 312 of the gas-actuated valve 302 to an exterior of the muzzle brake 100 (e.g., out of the muzzle brake 100), as described further below. In this configuration, the opening 312 of the gas-actuated valve 302 is angled to the central axis 150 by an angle 400 (e.g., where the angle 400 is between axis 401 and the central axis 150, with the axis 401 normal to the opening 312 and extending through the midpoint 373 of the opening 312). While the gas-actuated valve 302 is in the actuated position, the base section 305 may be angled relative to the central axis 150 by angle 412 (where angle 412 is shown between axis 316 and central axis 150, with axis 316 extending parallel with the base section 305 along a center of the base section 305). The angle 412 may be less than the angle 354 (e.g., angle 412 may have a smaller magnitude than a magnitude of the angle 354). The gases may flow across surfaces of the interior 380 of the muzzle brake 100 and transfer heat to the surfaces of the interior 380, which may reduce an energy of the gases. As the gas-actuated valve 302 returns to the non-actuated position, the gases may flow into the shoulder 320 via the opening 328 and may transfer heat to the surfaces of the shoulder 320, further decreasing the energy of the gases. The gases may then flow out of the muzzle brake 100 via the projectile exit 200 at a reduced pressure relative to gases flowing from conventional muzzle brakes that do not include the gas-actuated valve 302.

As shown by FIGS. 5-6, the body 102 of the muzzle brake 100 includes a first side opening 506 and a second side opening 512. The first side opening 506 and the second side opening 512 are each arranged off-axis relative to the central axis 150. The first side opening 506 is formed between wall 382 (which may be referred to herein as a forward wall) and a first angled side wall 516, and the second side opening 512 is formed between wall 382 and a second angled side wall 518. The first angled side wall 516 and the second angled side wall 518 are each joined to the end wall 340 (which may be referred to herein as a rearward wall). The first side opening 506 is arranged at a first side 520 of the body 102, and the second side opening 512 is arranged at a second side 522 of the body 102, opposite to the first side opening 506 across the central axis 150.

During conditions in which propellant gases flow into the muzzle brake 100 (e.g., following a firing of a projectile, such as projectile 300 shown by FIGS. 3-4 and described above, into the muzzle brake 100), the propellant gases may flow against the gas-actuated valve 302 and may pivot the gas-actuated valve 302 from the unactuated position to the actuated position. A portion of the propellant gases may flow against the gas-actuated valve 302 and/or walls of the body 102 (e.g., end wall 340 and/or first angled side wall 516) and may be directed out of the muzzle brake 100 via the first side opening 506, and a portion of the propellant gases may flow against the gas-actuated valve 302 and/or the walls of the body 102 (e.g., end wall 340 and/or second angled side wall 518) and may be directed out of the muzzle brake 100 via the second side opening 512. Propellant gases flowing out of the muzzle brake 100 via the first side opening 506 may be directed in a direction 510 off-axis to the central axis 150 (e.g., in a direction away from the central axis 150 and toward the rearward end 104 of the muzzle brake 100). Propellant gases flowing out of the muzzle brake 100 via the second side opening 512 may be directed in a direction 700 (shown by FIG. 7) off-axis to the central axis 150 and toward the rearward end 104 of the muzzle brake 100, where the direction 700 is mirror symmetrical to the direction 510 across the central axis 150. Further, a portion of the propellant gases may flow through the projectile opening 312 of the gas-actuated valve 302 prior to flowing against the walls of the body 102 and being directed to either of the first side opening 506 or the second side opening 512. In this configuration, the position of the projectile opening 312 while the gas-actuated valve 302 is in the actuated position may increase a flow of propellant gases out of first side opening 506 and/or second side opening 512 of the muzzle brake 100 while the amount of propellant gases flowing out of the projectile exit 200 is reduced due to the projectile exit 200 being blocked by the gas-actuated valve 302. As a result, an efficiency of recoil reduction of the muzzle brake 100 may be increased. A length 508 of the first side opening 506 and a length 514 of the second side opening 512 may be equal (e.g., a same amount of length), in some examples. Each of the length 508 and the length 514 may be greater than a diameter of the projectile opening 312 and a diameter of the projectile exit 200.

Figure 7:
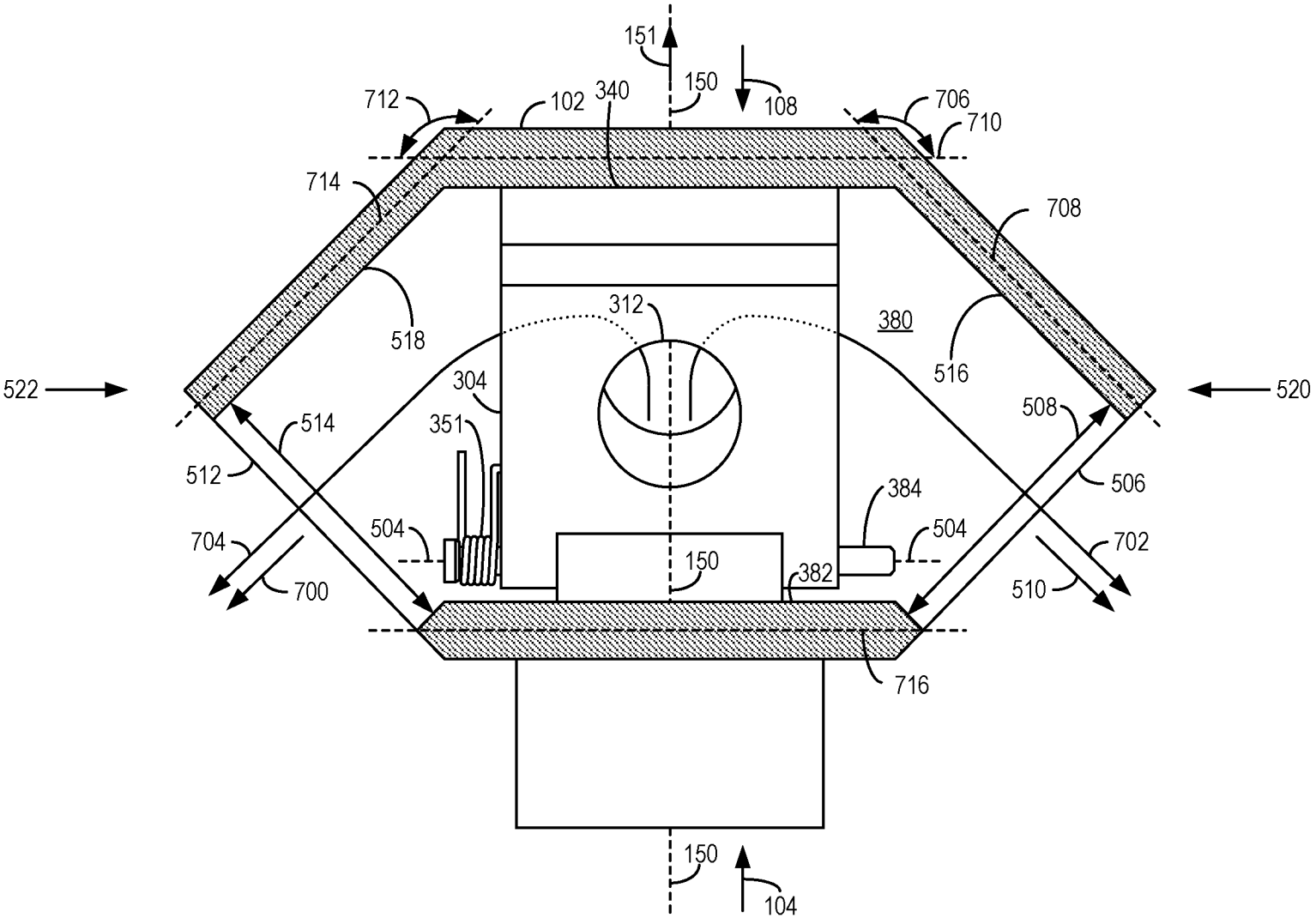
FIG. 7 shows a top sectional view of the muzzle brake.

Referring to FIG. 7, another sectional view of the muzzle brake 100 is shown. The view shown by FIG. 7 may be taken along line 381 shown by FIG. 3. FIG. 7 is a top view of the interior 380 of the body 102. As described above, during conditions in which the gas-actuated valve 302 is in the actuated position, gases may flow out of the muzzle brake via the first side opening 506 and/or the second side opening 512. As one example, propellant gases may flow from the projectile entrance 112 (shown by FIGS. 1 and 3-4) through the projectile opening 312 of the gas-actuated valve 302 and against interior surfaces (e.g., walls, such as end wall 340 arranged parallel with wall 382, as indicated by axis 710 centered on the end wall 340 and parallel with the end wall 340 being parallel with axis 716 centered on the wall 382 and parallel with the wall 382) of the muzzle brake 100. A portion of the propellant gases may be directed toward the first side opening 506 (e.g., along flow path 702), and a portion of the propellant gases may be directed toward the second side opening 512 (e.g., along flow path 704). Because the first angled side wall 516 is arranged at an angle 706 relative to the end wall 340 (where angle 706 is between axis 708 and axis 710, where axis 708 is centered on the first angled side wall 516 and parallel with the first angled side wall 516), propellant gases coming into contact with the end wall 340 and/or the first angled side wall 516 may be directed toward the first side opening 506 via the first angled side wall 516 and outward from the muzzle brake 100. Similarly, because the second angled side wall 518 is arranged at an angle 712 relative to the end wall 340 (where angle 712 is between axis 714 and axis 710, where axis 714 is centered on the second angled side wall 518 and parallel with the second angled side wall 518), propellant gases coming into contact with the end wall 340 and/or the second angled side wall 518 may be directed toward the second side opening 512 via the second angled side wall 518 and outward from the muzzle brake 100.

Figure 8:
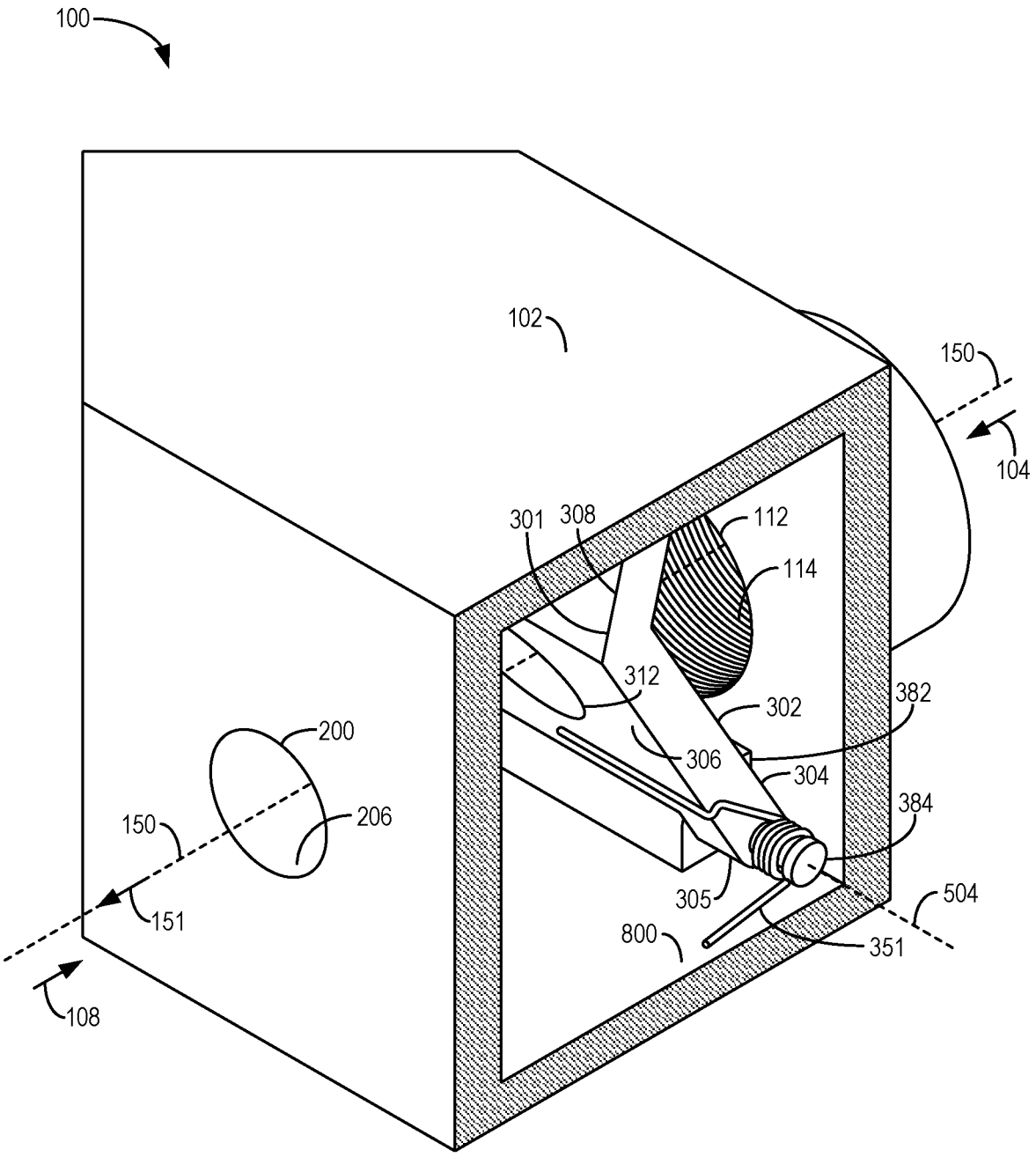
FIG. 8 shows another sectional perspective view of the muzzle brake with the gas-actuated valve in the first position.

Referring to FIG. 8, another sectional view of the muzzle brake 100 is shown. The view shown by FIG. 8 may be taken along line 271 in FIG. 2. As shown, the spring 351 is engaged with the gas-actuated valve 302 at lower surface 306 of the gas-actuated valve 302. The spring 351 is additionally engaged with a lower surface 800 of the body 102. In this configuration, the spring 351 biases the gas-actuated valve 302 toward the rearward end 104 and the projectile entrance 112.

In an example operation of the muzzle brake 100, a projectile (e.g., projectile 300) is first fired into the muzzle brake 100, with the projectile traveling through each of the projectile opening 312 of the gas-actuated valve 302 and the shoulder opening 328 toward the projectile exit 200. After the projectile has completely passed through at least the projectile opening 312, the gas-actuated valve 302 is pivoted by the combustion gases resulting from the firing of the projectile to close the shoulder opening 328 (e.g., cover the shoulder opening 328 with wall 301 of the gas-actuated valve 302). In this configuration, the projectile opening 312 of the gas-actuated valve 302 is arranged off-axis relative to the central axis 150. As the pressure of the combustion gases within the muzzle brake 100 decreases, the gas-actuated valve 302 may return from the actuated position to the equilibrium position. By configuring the gas-actuated valve 302 to close the shoulder opening 328 after the projectile has passed completely through the projectile opening 312 of the gas-actuated valve 302, an efficiency of the muzzle brake 100 may be increased (e.g., a recoil reduction of the muzzle brake 100 may be increased) without increasing the size (e.g., length and/or diameter) of the muzzle brake 100. As a result, a weight and/or cost of the muzzle brake may be reduced relative to conventional muzzle brakes.

Although the gas-actuated valve 302 is described herein as being normally closed (e.g., closed during conditions in which a projectile is not fired through the muzzle brake 100) and configured to open responsive to propellant gases of a projectile coming into contact with the gas-actuated valve 302 after the projectile has passed completely through the opening 312 of the gas-actuated valve 302, in other embodiments the gas-actuated valve may be normally closed and configured to open responsive a pressure of gases against the gas-actuated valve before the projectile has entered the opening of the gas-actuated valve. For example, a projectile fired into the muzzle brake may increase a pressure of gases (e.g., air and/or propellant gases) within the muzzle brake, and while the projectile is within the muzzle brake and has not yet traveled through the gas-actuated valve, the increased pressure of gases within the muzzle brake may cause the gas-actuated valve to transition from the closed position to the opened position (e.g., the gas-actuated valve may transition to the opened position responsive to the gas pressure exceeding a threshold pressure). While the gas-actuated valve is in the opened position, the projectile may travel through the opening of the gas-actuated valve toward the projectile exit of the muzzle brake. After the projectile has traveled completely through the opening of the gas-actuated valve, the pressure of gases within the muzzle brake may decrease and the gas-actuated valve may transition from the opened position to the closed position responsive to the decreased gas pressure (e.g., the gas-actuated valve may transition to the closed position responsive to the gas pressure reducing below the threshold pressure). As a result, the gas-actuated valve may decrease the amount of gases flowing out of the muzzle brake through the projectile exit (e.g., decrease the flow rate and/or turbulence of gases flowing to the projectile exit of the muzzle brake), which may increase a recoil reduction efficiency of the muzzle brake.

Figure 9:
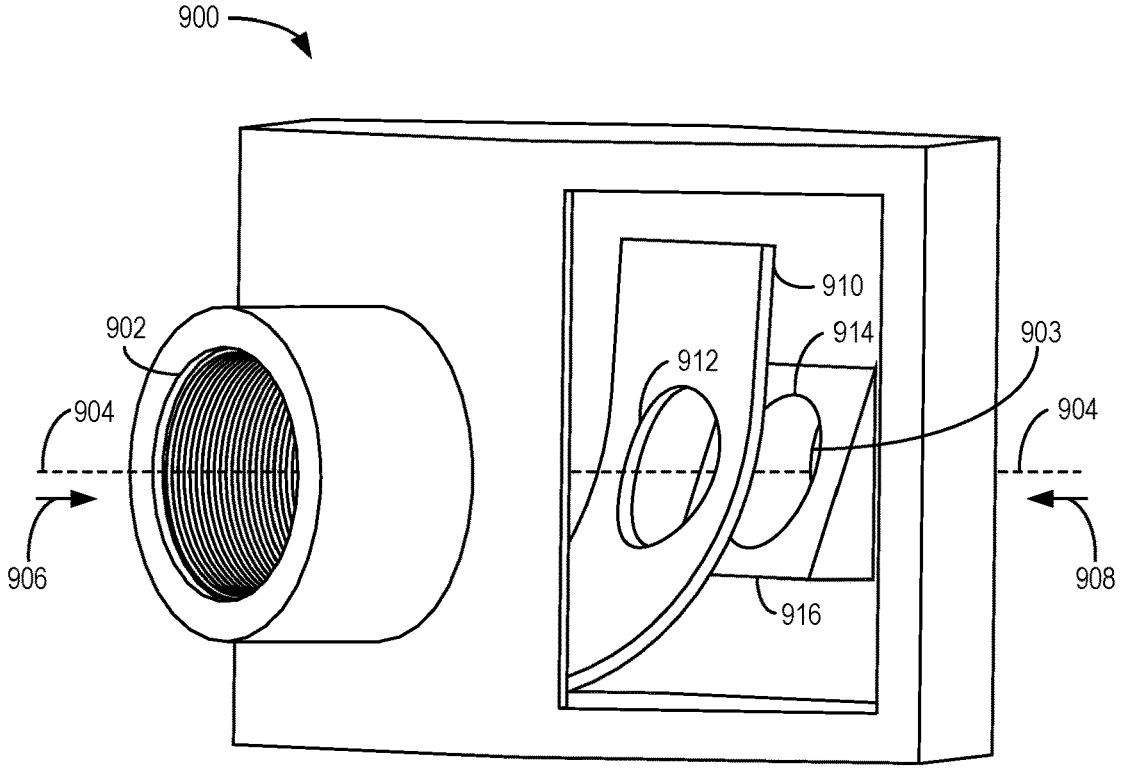
FIG. 9 shows a perspective view of a muzzle brake including a gas-actuated valve in an opened position.

Referring to FIG. 9, another muzzle brake 900 is shown according to an embodiment. The muzzle brake 900 includes several components similar to those described above with reference to the muzzle brake 100. In particular, the muzzle brake 900 includes projectile entrance 902 at rearward end 906 (similar to projectile entrance 112 and rearward end 104, respectively), projectile exit 903 at forward end 908 (similar to projectile exit 200 and forward end 108, respectively), and a shoulder 916 including an opening 914 at the forward end 908 (similar to shoulder 320 and opening 328 at forward end 108, respectively). The muzzle brake 900 additionally includes gas-actuated valve 910 disposed within the muzzle brake 900 and configured to pivot toward the shoulder 916.

The gas-actuated valve 910 may be described as a leaf spring valve where the body of valve 910 has a spring constant which operates the valve.

In the view shown by FIG. 9, the gas-actuated valve 910 is in an opened position (which may be referred to herein as a non-actuated position). The muzzle brake 900 may be coupled to a firearm barrel (e.g., firearm barrel 160 shown by FIG. 1 and described above) and a projectile fired by the firearm may travel through the muzzle brake 900 along central axis 904 from the projectile entrance 902, through opening 912 of the gas-actuated valve 910, through opening 914 of the shoulder 916, and to the projectile exit 903. Propellant gas within the muzzle brake 900 resulting from the firing of the projectile by the firearm may urge the gas-actuated valve 910 to pivot in the direction toward the opening 914 of the shoulder 916, and while the gas-actuated valve 910 is pressed against the opening 914 of the shoulder 916 by the propellant gases, the opening 914 is closed (e.g., sealed) by the gas-actuated valve 910. In the view shown by FIG. 10, the gas-actuated valve 910 is in the closed position in which the gas-actuated valve 910 covers the opening 914 of the shoulder 916.

After firing of the projectile, the spring force of the body of the gas-actuated valve 910 may urge the gas-actuated valve 910 back into the open position.

Figure 10:
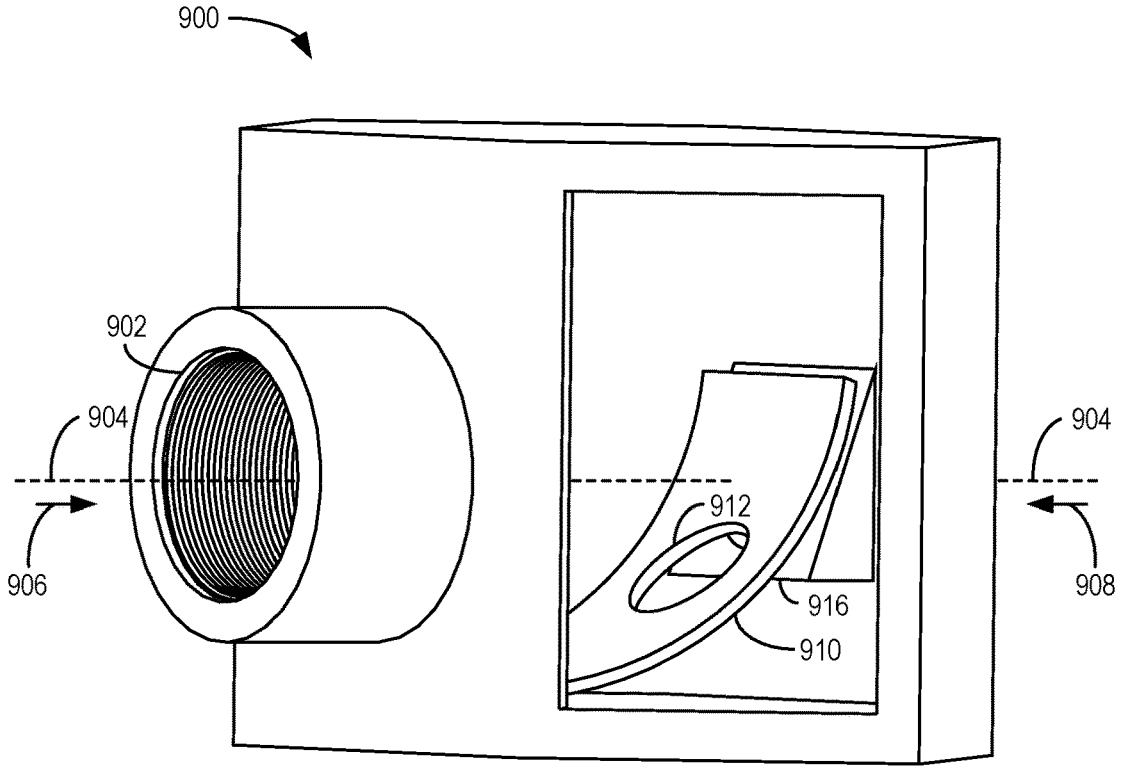
FIG. 10 shows a perspective view of the muzzle brake of FIG. 9 with the gas-actuated valve in a closed position.
Figure 11:
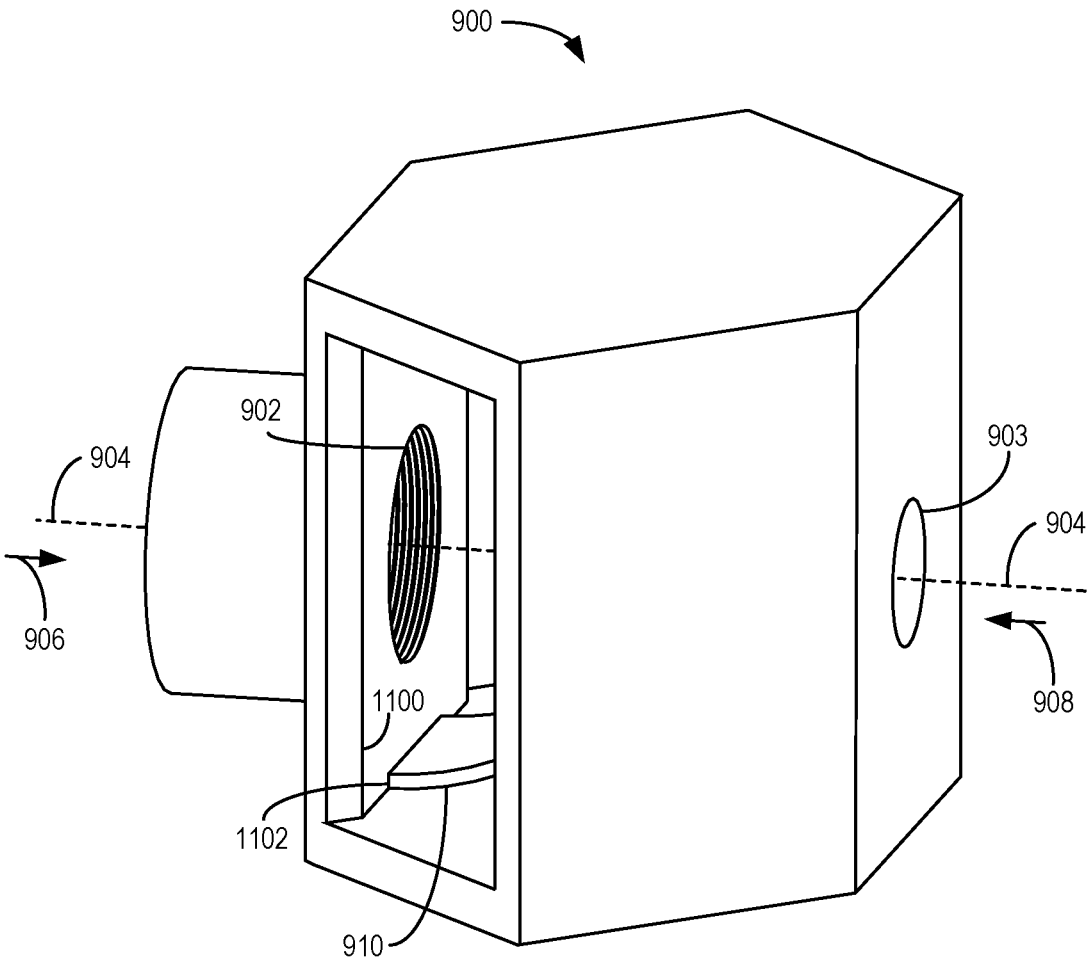
FIG. 11 shows another perspective view of the muzzle brake of FIGS. 9-10 with the gas-actuated valve in the closed position.

In the embodiment shown by FIGS. 9-11, the gas-actuated valve 910 is curved and is shaped to seat against the shoulder 916. As shown by FIG. 11, the gas-actuated valve 910 may be joined directly to an end wall 1100 of the muzzle brake 900 at joint 1102 (shown by FIG. 11). The joint 1102 may be referred to herein as a pivot of the gas-actuated valve 910. In one example, the gas-actuated valve 910 may be fused (e.g., welded) to the end wall 1100. In another example, the gas-actuated valve 910 may be formed together with the end wall 1100 (e.g., molded together). In yet another example, the gas-actuated valve 910 and/or end wall 1100 may be formed via an additive manufacturing process (e.g., 3D printing).

In some examples, during conditions in which the gas-actuated valve 910 is moved (e.g., pivoted) into engagement (e.g., face-sharing contact) with the shoulder 916, the curvature of the gas-actuated valve 910 may result in bending of the gas-actuated valve 910 to increase the amount of contact between the gas-actuated valve 910 and the shoulder 916. The increased contact between the gas-actuated valve 910 and the shoulder 916 may increase the sealing of the opening 914 of the shoulder 916 by the gas-actuated valve 910. Following the engagement of the gas-actuated valve 910 with the shoulder 916, the propellant gases may flow out of the muzzle brake 900. As a result of the gases flowing out of the muzzle brake 900, the pressure of gases within the muzzle brake 900 decreases and urging of the gas-actuated valve 910 toward the shoulder 916 is decreased. During such conditions, the gas-actuated valve 910 is biased away from the shoulder 916 and toward the opened position. As the gas-actuated valve 910 returns to the opened position, the curvature of the gas-actuated valve 910 may return to the original non-deformed curvature shown by FIG. 9. In other examples, the gas-actuated valve 910 may be sufficiently rigid such that the curvature of the gas-actuated valve 910 does not change (e.g., bend) during conditions in which the gas-actuated valve 910 is engaged with the shoulder 916. In such examples, the shoulder 916 may be curved similar to the gas-actuated valve 910 (e.g., the shoulder 916 may have a counterpart curvature relative to the curvature of the gas-actuated valve 910). In some embodiments, the gas-actuated valve may be a reed valve including two or more reed petals configured to move toward each other or away from each other responsive to a pressure of propellant gases generated by the firearm.

The disclosure also provides support for a muzzle brake, comprising: a body, a projectile entrance and a projectile exit, a gas-actuated valve biased toward the projectile entrance within an interior of the body, and a projectile opening of the gas-actuated valve arranged along a projectile path between the projectile entrance and the projectile exit. In a first example of the system, the gas-actuated valve is joined to a pivot and is rotatable relative to the body toward the projectile exit via the pivot. In a second example of the system, optionally including the first example, the gas-actuated valve includes: a base section joined to the pivot and including the projectile opening, and an angled extension section joined to the base section and shaped to close the projectile exit. In a third example of the system, optionally including one or both of the first and second examples, the body includes a shoulder arranged opposite to the projectile entrance, where the shoulder forms the projectile exit and includes an angled end surface shaped to engage with an angled extension section of the gas-actuated valve. In a fourth example of the system, optionally including one or more or each of the first through third examples, while the gas-actuated valve is in a non-actuated position, the projectile opening of the gas-actuated valve is arranged along the projectile path. In a fifth example of the system, optionally including one or more or each of the first through fourth examples, while the gas-actuated valve is in an actuated position, the projectile opening of the gas-actuated valve is offset from the projectile path. In a sixth example of the system, optionally including one or more or each of the first through fifth examples, the body comprises a forward wall forming the projectile entrance, a rearward wall forming the projectile exit, a first angled side wall and a second angled side wall angled opposite to each other and each joined to the rearward wall, a first side opening formed between the first angled side wall and the forward wall, and a second side opening formed between the second angled side wall and the forward wall. In a seventh example of the system, optionally including one or more or each of the first through sixth examples, the body includes a first side opening and a second side opening arranged between the projectile entrance and the projectile exit at opposing sides of the body, with the first side opening and the second side opening shaped to direct propellant gases away from the projectile exit. In an eighth example of the system, optionally including one or more or each of the first through seventh examples, the system further comprises: a first valve stop shaped to contact the gas-actuated valve while the gas-actuated valve is in an actuated position and a second valve stop shaped to contact the gas-actuated valve while the gas-actuated valve is in a non-actuated position. In a ninth example of the system, optionally including one or more or each of the first through eighth examples, the gas-actuated valve is a single, unitary piece formed from a metal material. The disclosure also provides support for a muzzle brake, comprising: a body, a projectile entrance and a projectile exit positioned on a projectile path, a gas-actuated valve and a shoulder arranged opposite to each other within an interior of the body, and a shoulder projectile opening arranged on the projectile path, and the shoulder projectile opening is blocked by the gas-actuated valve in an actuated position. In a first example of the system, with the gas-actuated valve in the actuated position, the valve projectile opening is arranged off-center to the shoulder projectile opening, and with the gas-actuated valve in a non-actuated position, the valve projectile opening is on the projectile path. In a second example of the system, optionally including the first example, a pivot of the gas-actuated valve is seated within an opening of a wall at the projectile entrance, the gas-actuated valve is biased toward the projectile entrance by a biasing member engaged with the gas-actuated valve and the body, and the shoulder is fixed at the projectile exit. In a third example of the system, optionally including one or both of the first and second examples, the gas-actuated valve is removable from the body and is shaped to couple with a pivot seated within the body. In a fourth example of the system, optionally including one or more or each of the first through third examples, the system further comprises: a valve projectile opening formed in the gas-actuated valve, wherein in the actuated position, the valve projectile opening forms a gas flow path to side openings of the muzzle brake. In a fifth example of the system, optionally including one or more or each of the first through fourth examples, the side openings include a first side opening and an opposing, second side opening opened at an end of the muzzle brake including the projectile entrance. The disclosure also provides support for a method, comprising: first, firing a projectile through each of a projectile opening of a gas-actuated valve of a muzzle brake and a shoulder opening of the muzzle brake, where the shoulder opening forms a projectile exit, and then, closing the shoulder opening via the gas-actuated valve. In a first example of the method, the method further comprises: after closing the shoulder opening, urging the gas-actuated valve away from the shoulder opening and toward an equilibrium position via a biasing member. In a second example of the method, optionally including the first example, closing the shoulder opening includes pivoting the gas-actuated valve toward the shoulder opening and covering the shoulder opening with a wall of the gas-actuated valve seated against an angled end surface of a shoulder forming the shoulder opening. In a third example of the method, optionally including one or both of the first and second examples, pivoting the gas-actuated valve toward the shoulder opening includes urging the gas-actuated valve toward the shoulder opening via combustion gases generated by the firing of the projectile.

It will be understood that the figures are provided solely for illustrative purposes and the embodiments depicted are not to be viewed in a limiting sense. It is further understood that the firearm muzzle brake described and illustrated herein represents only example embodiments. It is appreciated by those skilled in the art that various changes and additions can be made to such firearm muzzle brake without departing from the spirit and scope of this disclosure. For example, the firearm muzzle brake could be constructed from lightweight and durable materials not described.

As used herein, an element or step recited in the singular and then proceeded with the word "a" or "an" should be understood as not excluding the plural of said elements or steps, unless such exclusion is explicitly stated. Furthermore, references to "one embodiment" of the present subject matter are not intended to be interpreted as excluding the existence of additional embodiments that also incorporate the recited features. Moreover, unless explicitly stated to the contrary, embodiments, "comprising," "including," or "having" an element or a plurality of elements having a particular property may include additional such elements not having that property. The terms "including" and "in which" are used as the plain-language equivalents to the respective terms "comprising" and "wherein." Moreover, the terms "first," "second," and "third," etc. are used merely as labels, and are not intended to impose numerical requirements or a particular positional order on their objects.

This written description uses examples to disclose the invention, including best mode, and also to enable a person of ordinary skill in the relevant art to practice the invention, including making and using any devices or systems and performing any incorporated methods.

Unless otherwise described, the term approximately should be construed to define a range of 5% greater and less than the stated value. For example, a range of approximately 10% would define a range between 5-15%.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and sub-combinations of the various features, functions, acts, and/or properties disclosed herein, as well as any and all equivalents thereof.

It should be appreciated that while the muzzle brake may be unitary in its construction, and thus in a sense virtually all of its components could be said to be in contact with one another, the terms used herein are used to refer to a more proper understanding of the term that is not so broad as to mean simply that the various parts are connected or contacting through a circuitous route because a single unitary material forms the muzzle brake.

The invention claimed is:

1. A muzzle brake, comprising:

a body having a first side opening and a second side opening, wherein the first and the second side openings define a gas-escape path from an interior of the body;

a projectile entrance defined through a first end of the body and a projectile exit defined through an opposite second end of the body; and a gas-actuated valve having a projectile opening defined therethrough and positioned within the interior of the body, the gas-actuated valve being movable from proximate the projectile entrance to the projectile exit, wherein movement of the gas-actuated valve causes the projectile opening to move into and out of alignment with a central axis extending from the projectile entrance to the projectile exit.

2. The muzzle brake of claim 1, wherein the gas-actuated valve is joined to a pivot proximate to a lower surface of the body and is rotatable about the pivot from between the projectile entrance to the projectile exit.

3. The muzzle brake of claim 1, wherein the gas-actuated valve is movable between an actuated position and a non-actuated position, wherein when in the non-actuated position, the projectile opening is concentrically aligned about the central axis.

4. The muzzle brake of claim 1, wherein the first side opening and the second side opening are arranged at opposing sides of the body between the projectile entrance and the projectile exit.

5. The muzzle brake of claim 1, further comprising a first valve stop positioned proximate the projectile exit and a second valve stop positioned proximate the projectile entrance, wherein each valve stop is configured to limit a distance the gas-actuated valve moves between the projectile entrance and the projectile exit.

6. A muzzle brake, comprising:

a body having a first side opening and a second side opening formed on a side opposite the first side opening;

a projectile entrance and a projectile exit concentrically aligned with a projectile path defined along a central axis formed therebetween; and a gas-actuated valve movable within an interior of the body between proximate the projectile entrance to over the projectile exit.

7. The muzzle brake of claim 6, wherein the gas-actuated valve is movable between an actuated position and a non-actuated position, wherein in the actuated position of the gas-actuated valve, a projectile opening defined through the gas-actuated valve is arranged off-center from the projectile path, and in a non-actuated position of the gas-actuated valve, the projectile opening is arranged on the projectile path.

8. The muzzle brake of claim 6, further comprising a pivot coupled to the gas-actuated valve and a biasing member, wherein the pivot is positioned in the body below the projectile entrance, the biasing member configured to bias the gas-actuated valve toward the projectile entrance when in a non-actuated position.

9. The muzzle brake of claim 6, wherein the gas-actuated valve is removable from the body.

10. The muzzle brake of claim 6, further comprising:

a projectile opening defined through the gas-actuated valve, wherein when the gas-actuated valve is positioned over the projectile exit, the projectile opening is misaligned with the projectile path.

11. The muzzle brake of claim 6, wherein each side opening is formed in the body proximate to the projectile entrance and each side opening defines a gas-escape path from the interior of the body.

12. A muzzle brake, comprising: a body; a projectile entrance defined through a first end of the body and concentrically aligned with a projectile exit defined through an opposite end of the body; a gas-actuated valve positioned within an interior of the body and configured to move from proximate the projectile entrance to the projectile exit, the gas-actuated valve having a base section extending from a pivot formed in the body proximate the projectile entrance and joined to an angled extension section, a projectile opening defined through the base section, wherein the angled extension is configured to block the projectile exit when the gas-actuated valve moves toward the projectile exit.

13. The muzzle brake of claim 12, wherein the body further comprises an interior shoulder formed about the projectile exit and defining an angle configured to be substantially parallel to an angle of the angled extension section when positioned to block the projectile exit.

14. A muzzle brake, comprising: a body; a projectile entrance defined through a first end of the body and a projectile exit defined through an opposite second end of the body; and a gas-actuated valve integrally formed with the body and extending from an interior of the body, the gas-actuated valve having a projectile opening defined therethrough, wherein the gas-actuated valve is movable from proximate the projectile entrance to the projectile exit, wherein movement of the gas-actuated valve causes the projectile opening to move into and out of alignment with a central axis extending from the projectile entrance to the projectile exit, wherein the body and the gas-actuated valve are formed from a unitary piece of metallic materials.

* * * * *